US005984560A

United States Patent [19]

Bedol et al.

[11] Patent Number: 5,984,560

[45] **Date of Patent: *Nov. 16, 1999**

[54] STORAGE APPARATUS FOR RINGED NOTEBOOK OR RINGED BINDER

[75] Inventors: Mark A. Bedol, 3423 Yankton Ave., Claremont, Calif. 91711; Doug Noyes, Upland, Calif.

[73] Assignee: Mark A. Bedol, Claremont, Calif.

[ * ] Notice: This patent is subject to a terminal disclaimer.

[21] Appl. No.: 08/938,386

[22] Filed: Sep. 26, 1997

Related U.S. Application Data

[63] Continuation-in-part of application No. 08/537,436, Oct. 2, 1995, Pat. No. 5,695,294.

[51] Int. Cl.[6] ..... B42F 13/00

[52] U.S. Cl. ..... 402/79; 281/30; 281/38; 281/51; 402/1; 402/4; 402/80 L; 402/80 R

[58] Field of Search ..... 281/30, 38, 51; 402/1, 4, 79, 80 R, 80 L

[56] References Cited

U.S. PATENT DOCUMENTS

| | | | |
|---|---|---|---|
| 1,039,296 | 9/1912 | Krumming | 281/30 X |
| 1,308,437 | 7/1919 | Metcalfe | 281/30 |
| 1,894,241 | 1/1933 | Raynolds | 402/80 L |
| 1,904,572 | 4/1933 | Trussell | 402/4 |
| 2,097,626 | 11/1937 | Lesti | 402/4 |

(List continued on next page.)

FOREIGN PATENT DOCUMENTS

| | | | |
|---|---|---|---|
| 835316 | 12/1938 | France | 402/4 |
| 64148 | 10/1955 | France | 402/4 |
| 1396190 | 3/1965 | France | 402/4 |
| 2575419 | 7/1986 | France | 402/80 R |
| 817440 | 10/1951 | Germany | 402/4 |
| 17022 | of 1909 | United Kingdom | 402/4 |
| 7081 | of 1910 | United Kingdom | 281/30 |
| 11652 | of 1912 | United Kingdom | 281/30 |
| 217484 | 6/1924 | United Kingdom | 402/4 |
| 1564220 | 4/1980 | United Kingdom | 281/30 |

OTHER PUBLICATIONS

NiteOwl™ lighted notepad, Lumatec Industries, Inc., PO Box 279 Austin, Texas 78767–9830. Owner's Manual plus two photographs of device.

*Primary Examiner*—Andrea L. Pitts
*Assistant Examiner*—Monica Smith

[57] ABSTRACT

An apparatus for storing selected items within the covers of a ringed notebook or ringed binder. The notebook or binder is of a type that typically stores paper or accessories that do not extend to the full width of the covers thereby leaving presently unused volumes between the covers beyond the perimeter of the paper or other accessories. The present invention includes a thin main plate member and a storage device. The thin main plate member has a plurality of spaced openings therethrough. These spaced openings are arranged and sized so as to accommodate the rings of a ringed notebook or ringed binder. The storage device stores at least one selected item. This storage device means extends from the main plate member into a presently unused volume between the covers. Thus, the normally unused volume can be utilized to store the selected item. The storage device includes a plurality of spaced arms for grasping the at least one selected item.

43 Claims, 8 Drawing Sheets

U.S. PATENT DOCUMENTS

| | | | |
|---|---|---|---|
| 2,160,392 | 5/1939 | Schade . | |
| 2,184,823 | 12/1939 | Vernon . | |
| 2,194,003 | 3/1940 | Brooks | 281/3 |
| 2,200,146 | 5/1940 | Block | 281/30 |
| 2,223,560 | 12/1940 | Friedlaender | 281/31 |
| 2,279,987 | 3/1942 | Kengott . | |
| 2,318,192 | 5/1943 | Boelema, Jr. | 281/31 |
| 2,453,459 | 11/1948 | Roberts . | |
| 2,505,694 | 4/1950 | Stuercke . | |
| 2,647,517 | 8/1953 | Bilbrey . | |
| 2,673,099 | 3/1954 | Hamilton | 281/15 |
| 2,704,077 | 3/1955 | Prillaman . | |
| 2,821,197 | 1/1958 | Bilbrey . | |
| 3,126,891 | 3/1964 | Caputi . | |
| 3,366,118 | 1/1968 | Beyer . | |
| 4,157,757 | 6/1979 | Gallaher, Jr. | 206/328 |
| 4,430,015 | 2/1984 | Nerlinger | 402/79 |
| 4,555,018 | 11/1985 | Cho | 206/214 |
| 4,595,309 | 6/1986 | Chinchar | 402/80 R |
| 4,704,042 | 11/1987 | Eisen et al. | 402/79 |
| 4,820,071 | 4/1989 | Steinfield et al. | 402/4 |
| 4,909,652 | 3/1990 | Harrison | 402/80 R |
| 4,918,632 | 4/1990 | York | 364/708 |
| 5,058,736 | 10/1991 | Bedol | 206/214 |
| 5,118,138 | 6/1992 | Brotz | 281/51 |
| 5,118,213 | 6/1992 | Merservy et al. | 402/80 R |
| 5,209,592 | 5/1993 | Bedol | 402/1 |
| 5,316,341 | 5/1994 | Schwartz | 281/15.1 |
| 5,409,319 | 4/1995 | Bedol | 402/1 |
| 5,460,414 | 10/1995 | Sargis | 281/38 |
| 5,476,336 | 12/1995 | Osiecki et al. | 402/79 |
| 5,498,089 | 3/1996 | Motyka | 402/4 |
| 5,503,489 | 4/1996 | Maudal | 402/80 L |
| 5,597,256 | 1/1997 | Burton et al. | 402/4 |
| 5,695,294 | 12/1997 | Bedol et al. | 402/79 |

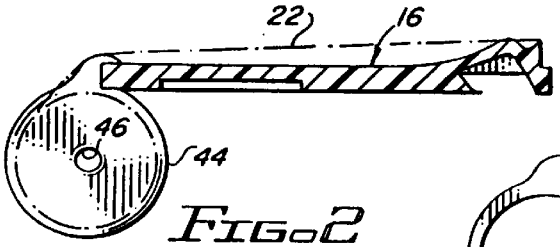
FIG. 2
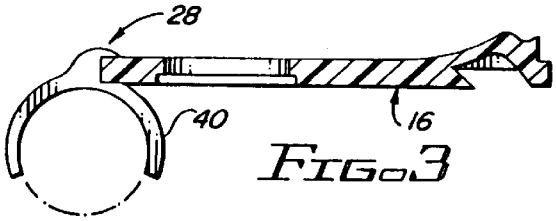
FIG. 3
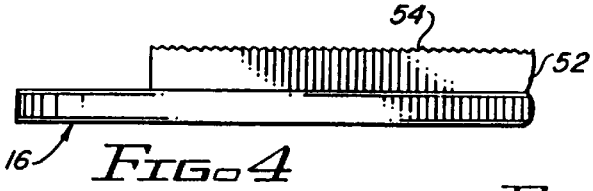
FIG. 4
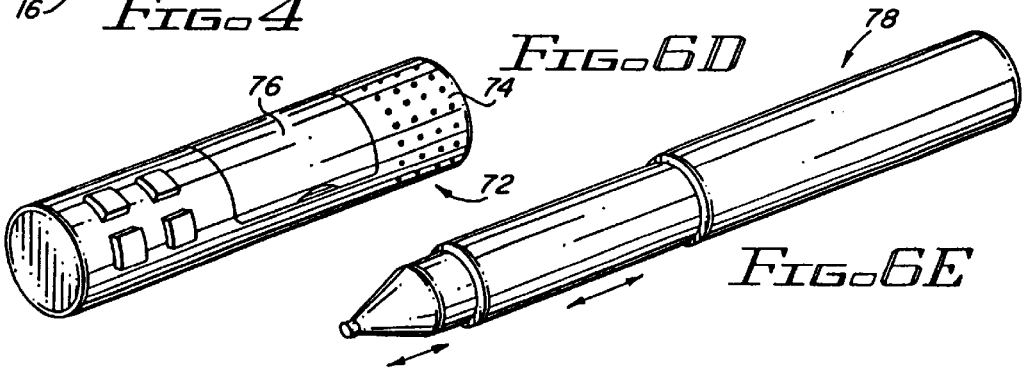
FIG. 6D
FIG. 6E
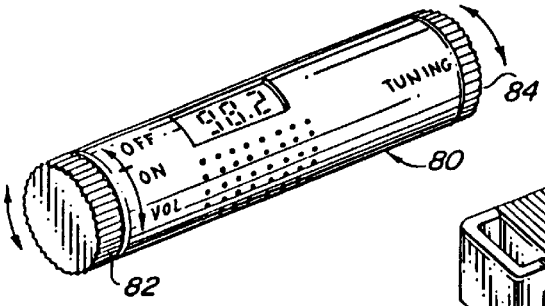
FIG. 6F
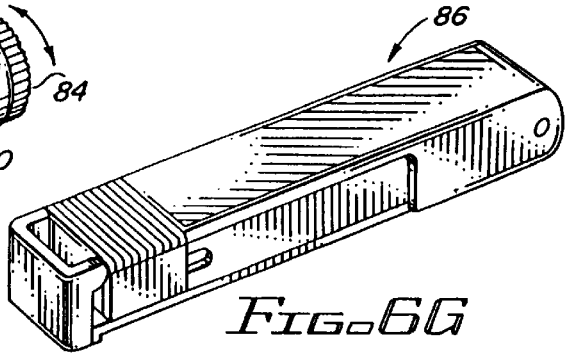
FIG. 6G
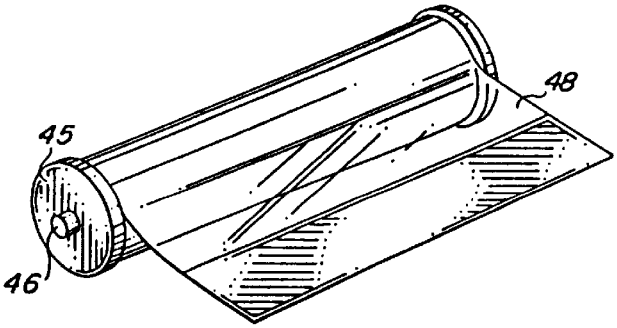
FIG. 6H
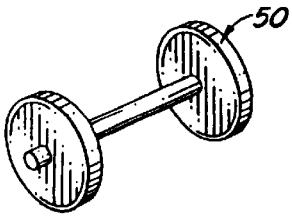
FIG. 6I

STORAGE APPARATUS FOR RINGED NOTEBOOK OR RINGED BINDER

This application is a Continuation-In-Part of application Ser. No. 08/537,436, filed on Oct. 2, 1995 issued as U.S. Pat. No. 5,695,294.

BACKGROUND OF THE INVENTION

1. Field of the Invention

The present invention relates to inserts for ringed notebooks and ringed binders and, more particularly, to a notebook insert which provides a storage mechanism within the normally unused volumes formed between the covers of the notebooks/binders, beyond the perimeter of paper or other accessories.

2. Description of the Related Art

Users of notebooks, including businessmen and students, often desire to have various articles such as pencils and pens at their easy disposal when they use their notebook and to be secure from being lost when they carry their notebooks from one location to another.

In partial solution to this problem, present applicant Mark A. Bedol, invented a "Notebook Organizer Including Slidable Element", U.S. Pat. No. 5,050,736. The 5,050,736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant Mark A. Bedol, has also invented "Notebook Insert With Calculator and Holepunch", U.S. Pat. No. 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

Although these prior art devices are effective in attempting to maximize the usable space within a notebook, they have not exploited the volume within the rings of the notebook.

OBJECTS AND SUMMARY OF THE INVENTION

It is, therefore, a principal object of the present invention to provide optimal utilization of all of the space within a ringed notebook or ringed binder.

This and other objects are achieved by the present invention which is an apparatus for storing selected items within the covers of a ringed notebook or ringed binder. The notebook or binder is of a type that typically stores paper or accessories that do not extend to the full width of the covers thereby leaving presently unused volumes between the covers beyond the perimeter of the paper or other accessories. In its broad aspects, the present apparatus comprises a thin main plate member and storage means. The thin main plate member has a plurality of spaced openings therethrough. These spaced openings are arranged and sized so as to accommodate the rings of a ringed notebook or ringed binder. The storage means stores at least one selected item. This storage means extends from the main plate member into a presently unused volume between the covers. Thus, the normally unused volume can be utilized to store the selected item. The storage means includes a plurality of spaced arms for grasping the at least one selected item.

Thus, the previously unused volume can be utilized to store the selected item.

In one embodiment the storage means comprises a snap on holder. This snap on holder may comprise a storage plate member, locking means and a storage item receiving element. The locking means is associated with the storage plate member for securely attaching the storage plate member to the main plate member. The storage item receiving element extends from a first end of the storage plate member wherein during use of the apparatus the storage item receiving element extends into the normally unused volume between the covers of the notebooks/binders.

In a second embodiment, the storage means is integrally connected to the main plate member.

In another embodiment, the thin main plate has an opening formed in an edge surface thereof and the storage means comprises a male member sized to fit within the opening.

As will be explained below, a variety of different items can be secured by the apparatus of the present invention.

Other objects, advantages, and novel features will become apparent from the following detailed description of the invention when considered in conjunction with the accompanying drawings.

BRIEF DESCRIPTION OF THE DRAWINGS

FIG. 2 is a view taken along Line 2—2 of FIG. 1.

FIG. 3 is a view taken along Line 3—3 of FIG. 1.

FIG. 4 is a view taken along Line 4—4 of FIG. 1.

FIG. 6D shows a recording device that may be used; FIG. 6E shows a telescoping ballpoint pen which may be stored; FIG. 6F shows a radio that can be stored; FIG. 6G shows a stapler that can be stored; FIG. 6H shows a lull reel of a roll of material that can be stored; FIG. 6I shows an empty small reel that can be stored.

The same parts or elements throughout the drawings are designated by the same reference characters.

DETAILED DESCRIPTION OF THE PREFERRED EMBODIMENT

Figure 1:
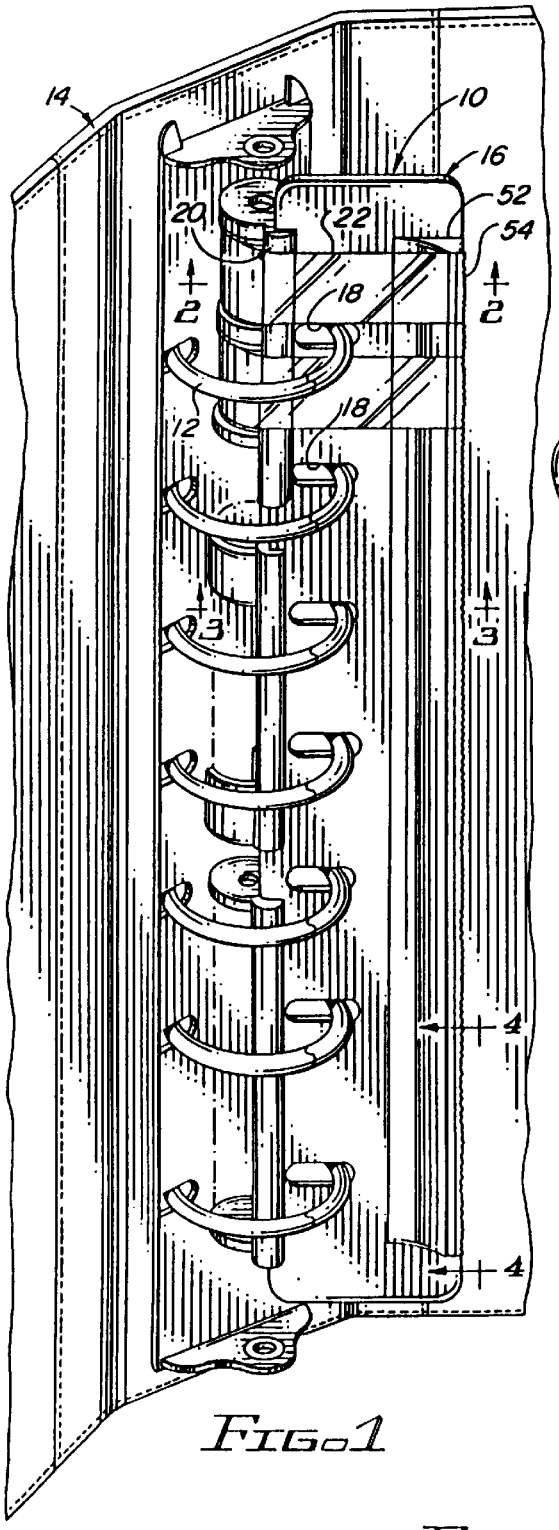
FIG. 1 is a front perspective view of a first embodiment of the present invention, utilized with a seven-hole ringed notebook, the invention being used to store a tape holder.

Referring now to the drawings and the characters of reference marked thereon, FIG. 1 illustrates a first embodiment of the apparatus of the present invention designated generally as 10, shown attached to the rings 12 of a conventional ringed binder, designated generally as 14. The apparatus 10 includes a thin main plate member, designated generally as 16 having a plurality of spaced openings 18 therethrough (in this instance seven openings 18). The openings 18 are arranged and sized so as to accommodate the rings 12 of a ringed notebook or a ringed binder. Storage means, as indicated generally as 20, is utilized to store a selected item, for instance, in the embodiment shown in FIG. 1, a roll of tape 22. The storage means 20, as will be explained in detail below, extends from the main plate member 16 into the volume formed within the rings 12 so that the volume, which is normally unused, can be utilized to store the selected item, i.e., tape 22.

Figure 7:
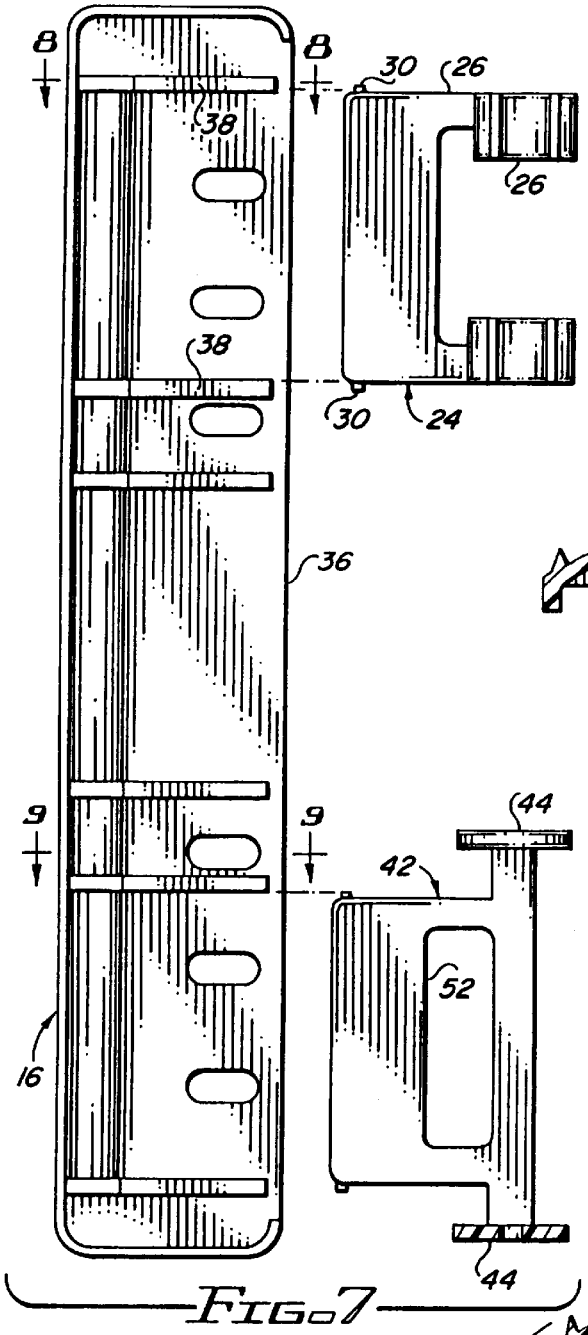
FIG. 7 is a rear plan view of a second embodiment of the present invention in which the main plate member has six holes to accommodate a similarly designed six-hole ringed notebook, this view showing how the snap on holder becomes secured.
Figure 9:
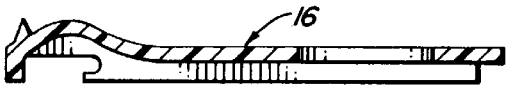
FIG. 9 is a view taken along 9—9 of FIG. 7.

Referring now to FIG. 7, a first type of storage means 20 is shown. which involves use of a snap on holder, designated generally as 24. The snap on holder 24 includes a storage plate member 26, locking means, and spaced arms 28, i.e., a storage item receiving element 28. The storage item receiving element 28 extends from a first end of the storage plate member 24 wherein during use of the apparatus 10, the storage item receiving element 28 extends into the volume formed within the rings.

Figure 8:
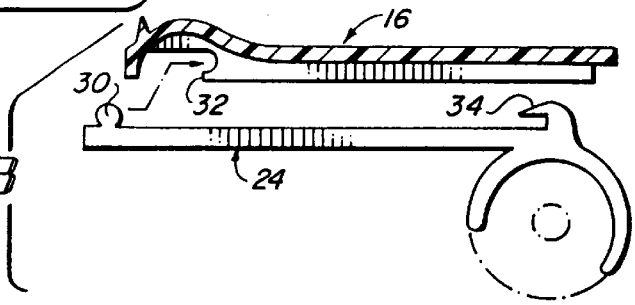
FIG. 8 is a view taken along Line 8—8 of FIG. 7, illustrating the locking mechanism of the present invention.
Figure 12:
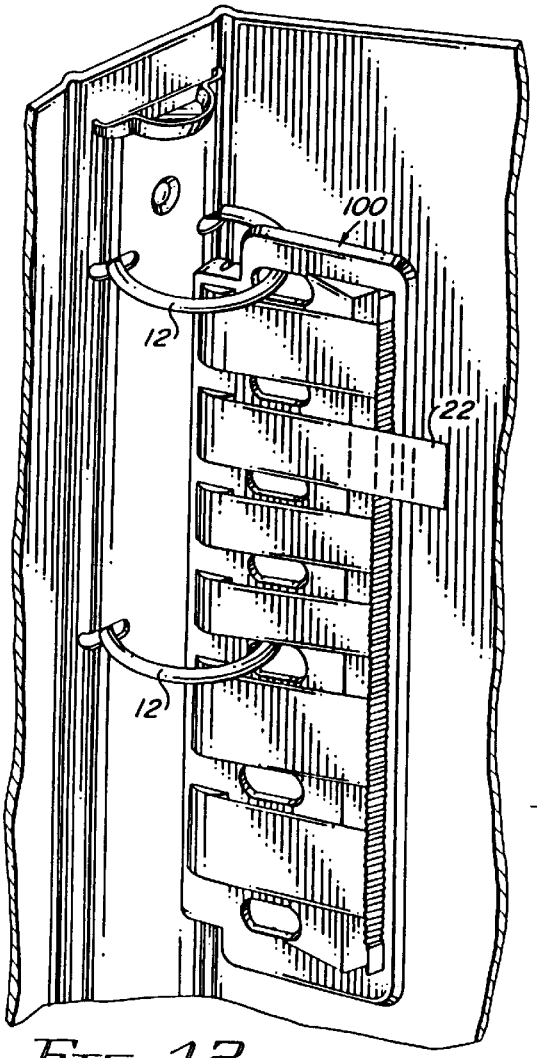
FIG. 12 is a front perspective view of another embodiment of the present invention in which the storage means is integrally connected to the main plate member, the invention shown connected to a ringed notebook.
Figure 13:
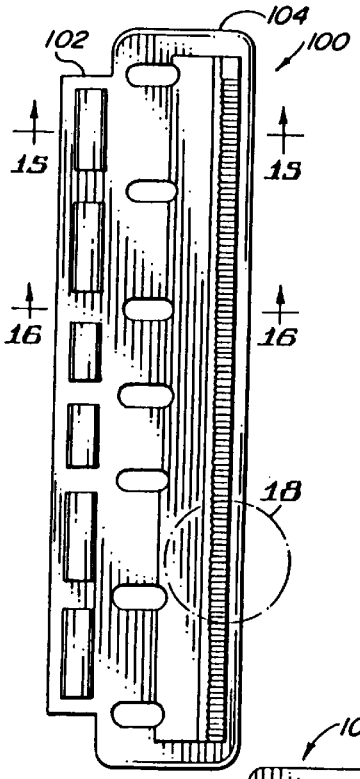
FIG. 13 is a front plan view of the embodiment of FIG. 12.
Figure 14:
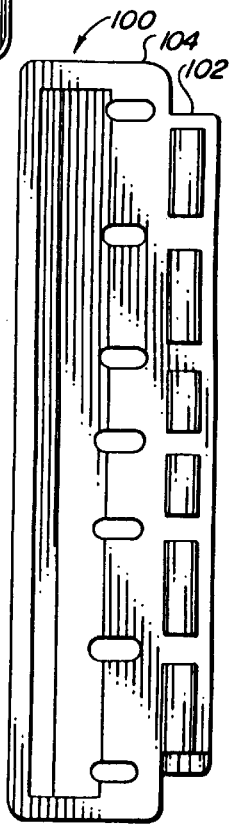
FIG. 14 is rear plan view thereof.
Figure 15:
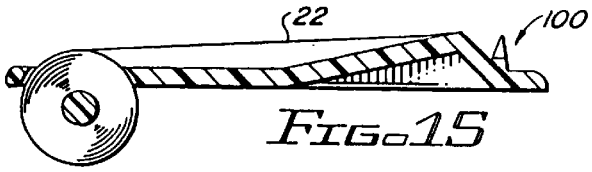
FIG. 15 is a view taken along Line 15—15 of FIG. 13.
Figure 16:
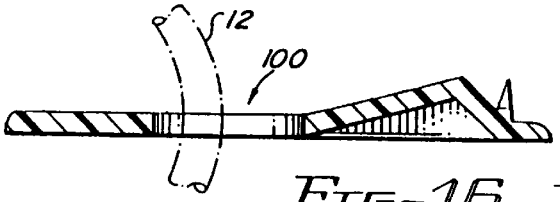
FIG. 16 is a view taken along Line 16—16 of FIG. 13.
Figure 17:
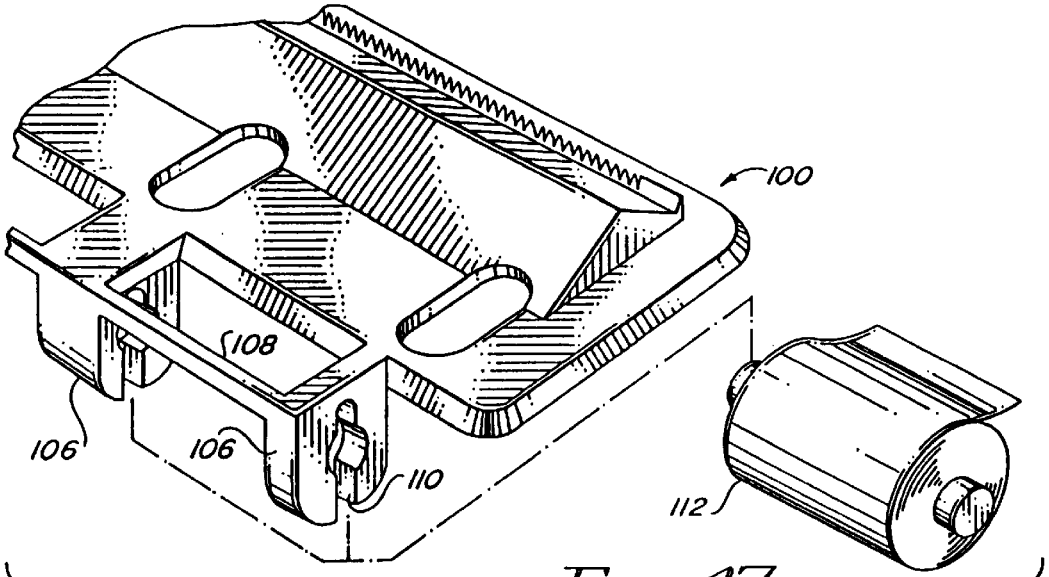
FIG. 17 is a perspective view illustrating how a roller is inserted in the slotted arms of the FIG. 12 embodiment.
Figure 18:
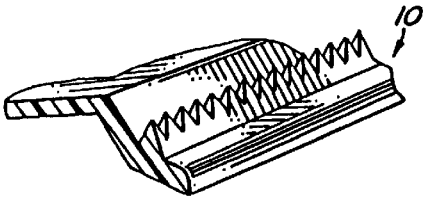
FIG. 18 is a perspective view of a portion of the cutting element of the FIG. 12 embodiment, with a serrated edge, taken along Section 18 of FIG. 13.

The locking means comprises a pair of tabs 30 on a second end of the storage plate member 24 for engagement with tab reception elements 32 (best seen in FIG. 8) formed on a rear surface of the main plate member 16. The locking means also preferably includes an edge receiving tab element 34 (also best seen in FIG. 8) positioned on the storage plate member 24 for engagement with a portion of the edge 36 of the main plate member 16. Thus, by use of the locking mechanism described, the snap on holder 24 can be securely positioned on the main plate member 16. Movement in the orthogonal direction is prevented by the guideways 38 formed on the main plate member 16.

Figure 6A:
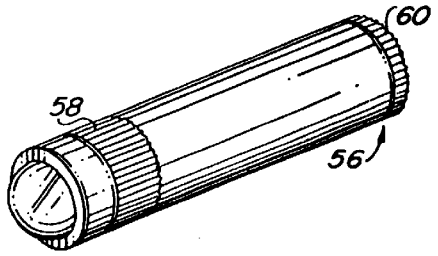
FIG. 6A is a perspective view of a small flashlight which can be stored by the apparatus of the present invention.

The storage item receiving element may comprise different embodiments. For example, the storage item receiving element 28 comprises a pair of spaced, generally U-shaped cylinder receiving elements (i.e. spaced arms) 40 (best seen in FIG. 3) for receiving the selected item, the selected item in this instance having a cylindrical shape. In the lower part of FIG. 7, a second type of storage item receiving element is illustrated, designated generally as 42. Element 42 comprises a pair of opposed spaced, circular reel receiving elements 44 (see also FIG. 2). Each element 44 has a central opening 46 therethrough for receiving a post of a reel. Referring now to FIG. 6H, such a reel is illustrated, the post thereof being designated as 46. The reel 45 is shown with a relatively full roll 48 of material. Such material may be, for example, tape or paper with a tacky back surface.

Figure 5:
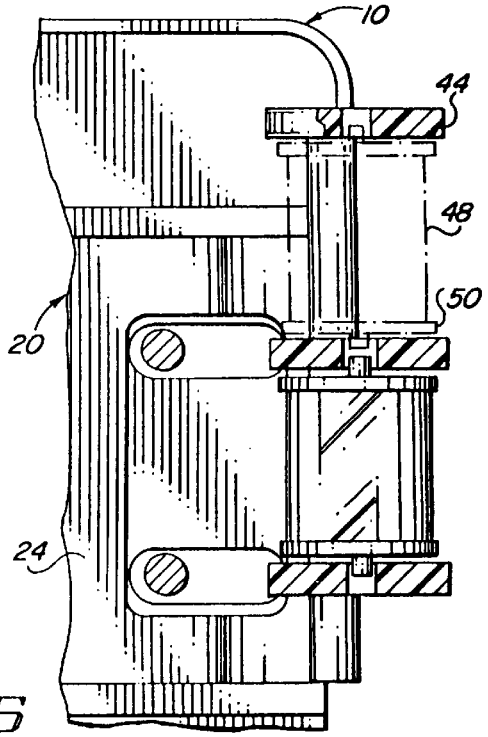
FIG. 5 is a rear view of a portion of the upper end of the apparatus of FIG. 1.

As illustrated in FIG. 6I, the inventive concepts herein are not limited to a particular size reel, and in fact, a relatively small reel 50 may be used. The utilization of different sizes is constrained by the spacing of the guideposts 38 and also the location of the openings 18. Thus, for example, storage plate member 42 includes an opening 52 (see FIG. 7) formed therein to accommodate the rings 12. This association of elements can be best seen by reference to FIG. 5, in which the storage plate member 24 is shown in place.

Referring again now to FIGS. 1–4, the contour of the front surface of the storage plate member 16 can be seen. Storage plate member 16 includes a cutting element 52 formed thereon with a serrated edge 54. This cutting element 52 provides convenient cutting of the tape 22.

Various cylindrical items are shown in FIGS. 6A–6F to illustrate the variety of items that may be stored. 6A shows a flashlight 56, which may include a rotatable on/off switch 58 and a screwable battery access 60.

Figure 6B:
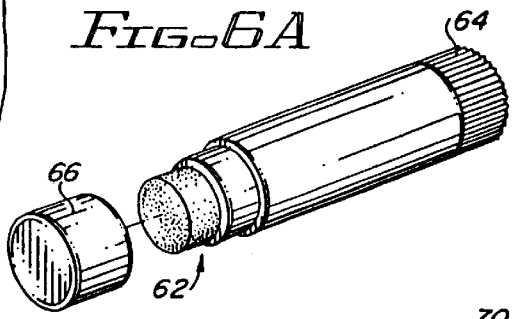
FIG. 6B is a perspective view of a glue stick or lipstick which can be stored utilizing the present invention.

FIG. 6B shows an item which may be, for example, a glue stick or lipstick 62 with a rotatable actuator 64 and cap 66.

Figure 6C:
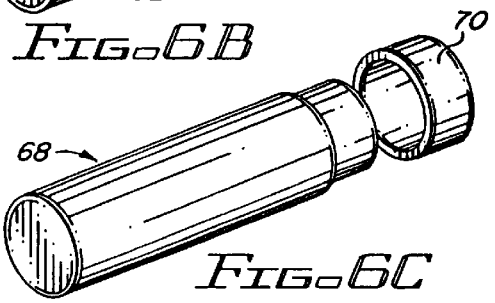
FIG. 6C shows a pill container which can be stored utilizing the present invention.

FIG. 6C shows a pill container 68 with a removable cap 70.

FIG. 6D shows a recording device 72 with microphone 74 and access cover 76 to the tape reel.

FIG. 6E illustrates a writing instrument, which may comprise, for example, a telescoping ballpoint pen.

FIG. 6F illustrates a cylindrical radio 80 with rotatable on/off and volume switch 82 and tuning switch 84.

Figure 6J:
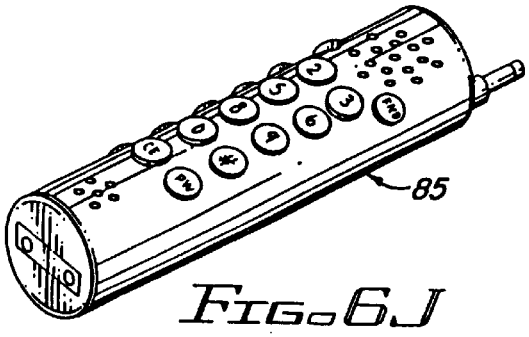
FIG. 6J illustrates a cellular telephone which may be stored.

FIG. 6J illustrates a cellular telephone 85.

Figure 6K:
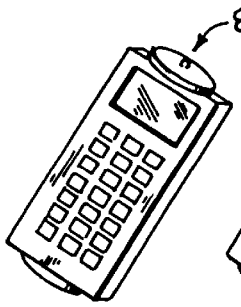
FIG. 6K shows a calculator that can be stored.
Figure 6L:
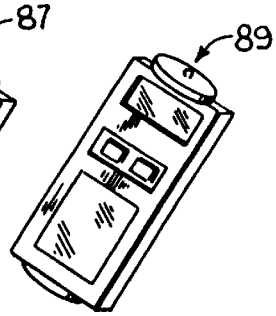
FIG. 6L shows a clock that can be stored.
Figure 6M:
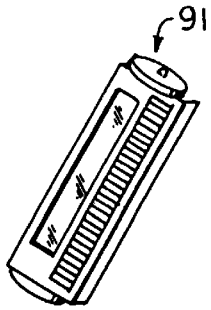
FIG. 6M shows an electronic E-mail and data bank that can be stored.
Figure 6N:
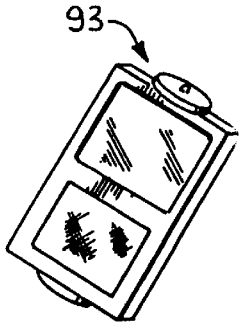
FIG. 6N shows a television that can be stored.

The principles of the present invention are not limited to items having cylindrical cross-sections. For example, with receiving arms 28, of the proper geometry, other shaped objects may be stored, for example, a small stapler 86 as illustrated in FIG. 6G. FIG. 6K shows a calculator 87 that can be stored. FIG. 6L shows a clock 89 that can be stored. FIG. 6M shows an electronic E-mail and data bank 91. FIG. 6N illustrates a miniature television 93.

Figure 10:
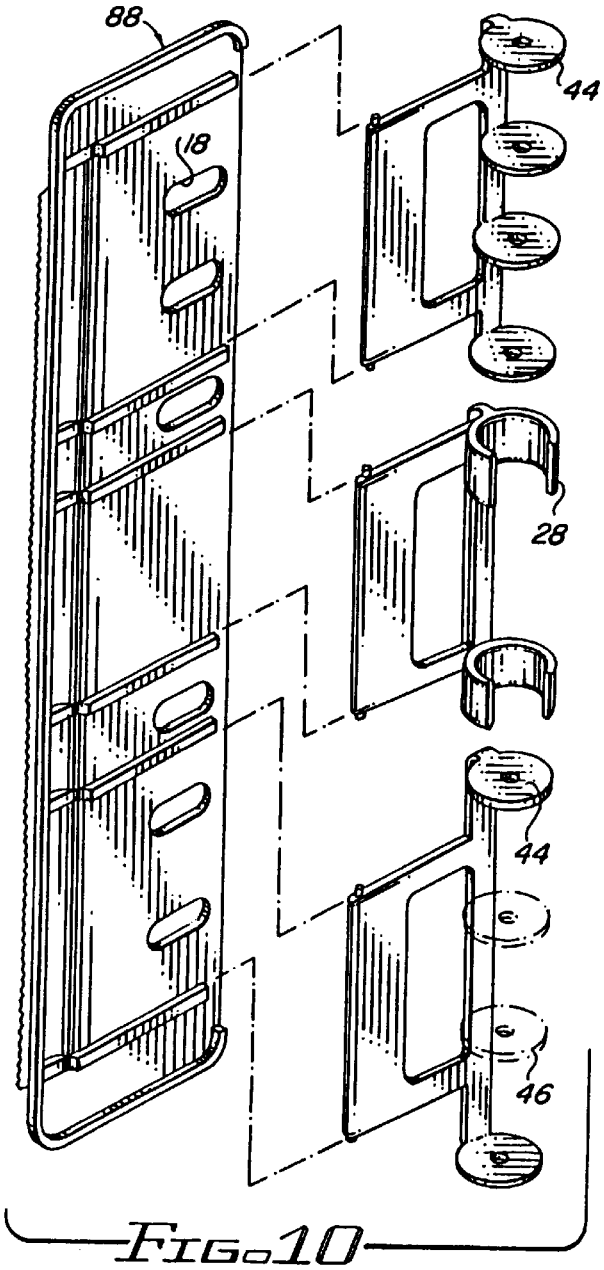
FIG. 10 is a rear perspective view of the six-hole main plate member utilized with a variety of snap on holders.

Also, as emphasized in FIG. 1, different storage items may be utilized with the same storage plate member 16. FIG. 10 also illustrates the variations of snap on holders possible with the present invention. First it is noted that FIG. 10 involves the use of a main plate member 88 with six openings 18. The receiving elements 28, 44 can be varied in accordance with the spacings inherent with the opening 18 spacings. Different alternatives are available, as indicated by phantom lines 46.

Figure 11:
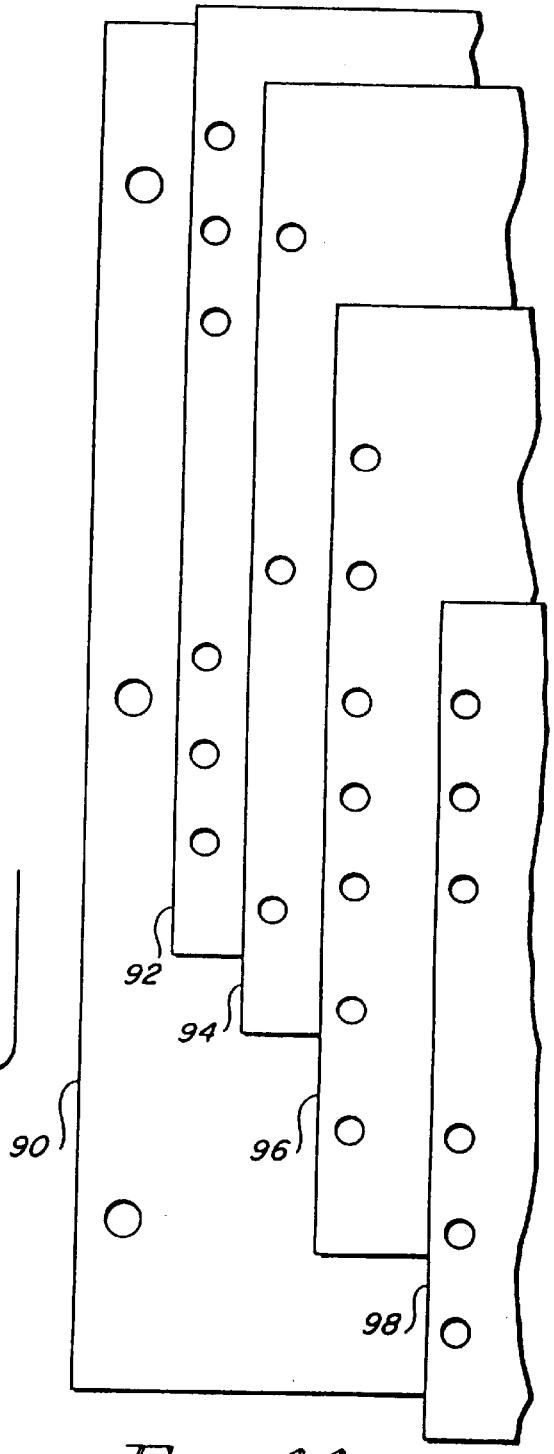
FIG. 11 illustrates an assortment of hole patterns of main plate members which can be used.

FIG. 11 illustrates the assorted hole patterns that may be utilized for the main plate members in accordance with the variety of ringed notebooks and ringed binders that are commercially available. Member 90 is a large three-hole member. Member 92 is of the six-hole type. Member 94 is a relatively small three-hole type. Member 96 is of the seven-hole type.

Member 98 is a six-hole type.

Referring now to FIGS. 12–18, another embodiment of the present invention is illustrated, designated generally as 100. In this embodiment, the storage means (i.e., reel receiving elements 102 are integrally connected to the main plate member 104). Furthermore, the spaced arms 106 are integrally connected by elements 108. Arms 106 include slots 110 for holding the reels 112.

Figure 20:
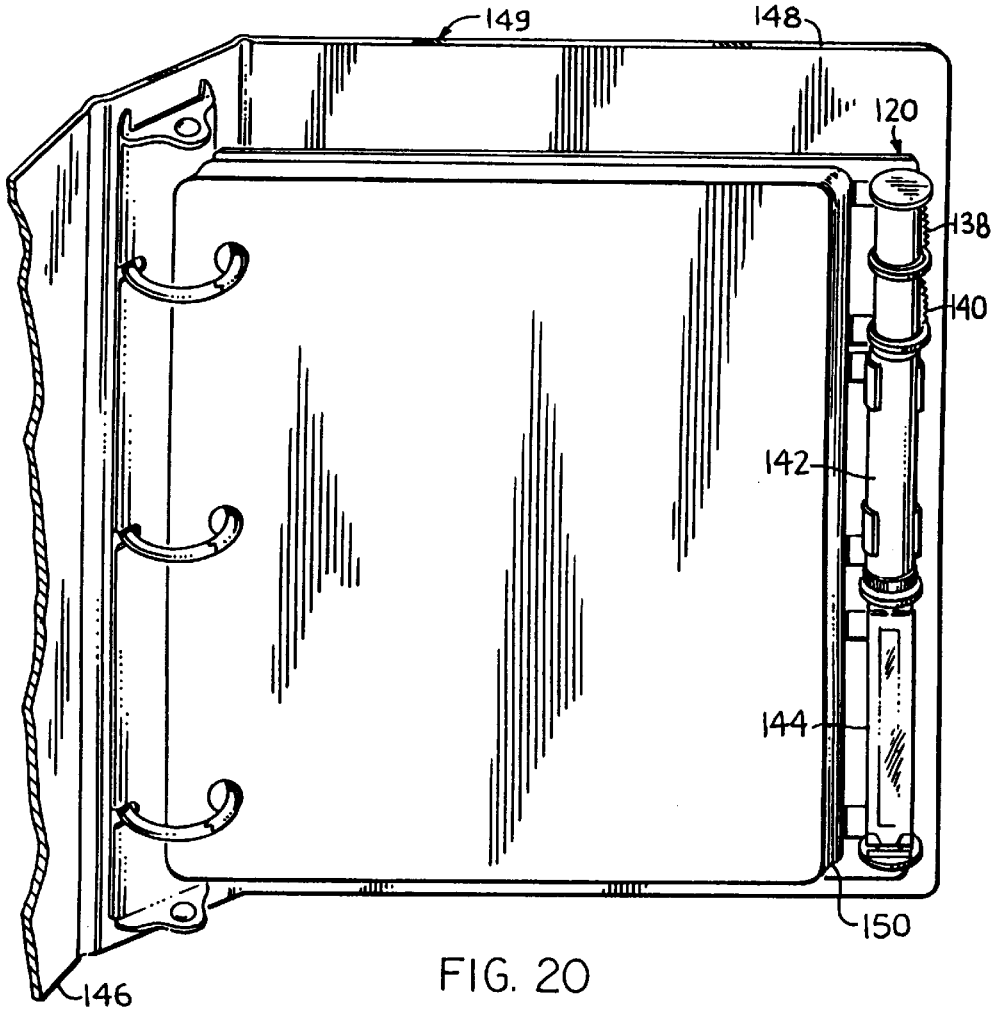
FIG. 20 is a front perspective view of the device of FIG. 19, shown inserted into a ringed binder.
Figure 19:
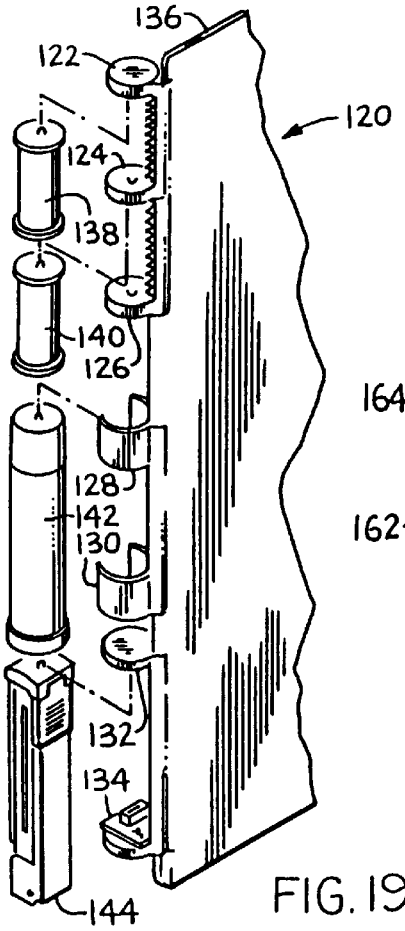
FIG. 19 is an exploded perspective view of a portion of an embodiment of the present invention in which the unused volume beyond the width of the paper is utilized to store selected items.
Figure 21:
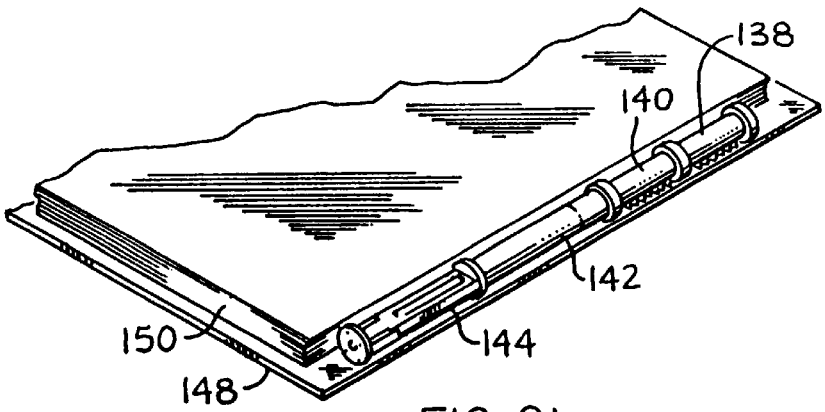
FIG. 21 is an end perspective view of the FIG. 19 embodiment.

Referring now to FIGS. 19–21, another embodiment of the present invention is illustrated, designated generally as 120. In this embodiment, the various grasping arms 122, 126, 128, 130, 132, and 134 are integrally connected to the main plate member 136. Various items may be supported by the grasping arms such as, for example, tape rollers 138, 140; a glue stick 142; and a stapler 144.

As clearly shown by reference to FIGS. 20 and 21, the principles of the present invention extend to the utilization of the unused volume between the covers 146, 148 of a notebook binder 149, beyond the width of the paper 150, to store the selected items. In other words, the storage means extends from a second side of the main plate, i.e. the side opposite the openings which provide access for the rings.

Figure 22:
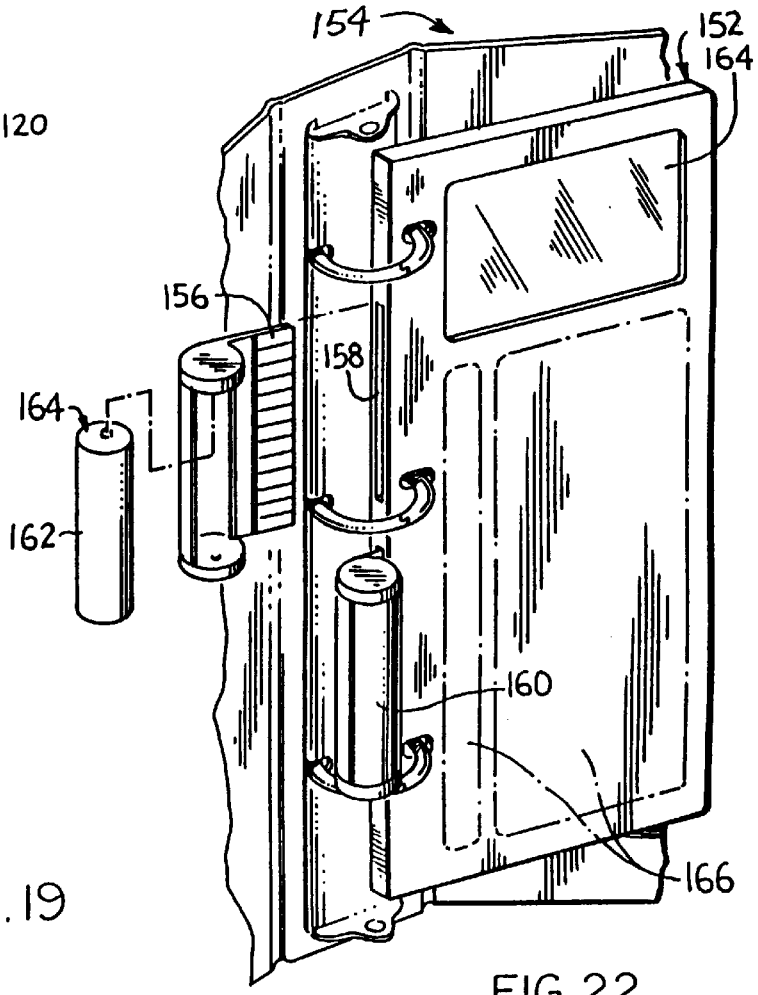
FIG. 22 is a perspective view of another embodiment which provides for plug-in storage means.

Referring now to FIG. 22, another embodiment of the present invention is illustrated, designated generally as 152, shown within a binder 154. The apparatus 152 is an electronic unit that can be, for example, a calculator; or databank of the type that stores, into memory, phone numbers and addresses and has other appointment alarm clock and electronic features. It can as well be an e-mail type device for communicating by way of connection to the phone lines to upload and download information. This electronic unit 152 can also be a portable computer in a small compact size that will fit inside the rings of a binder. A portable television also can be sized as to fit. A document scanner of the size to fit inside of a binder can also be utilized. A digital camera as well. The above mentioned units require a power source that becomes very bulky for the purposes of fitting inside the binder 154. In order to solve this problem the battery and even memory storage (the type that is commonly referred to as "flash memory" cards) can be stored outside the perimeter of the paper.

A male member 156 is sized to fit within an elongated slot or opening 158 in an edge surface of the electronic unit (i.e. main plate) 152. FIG. 22 shows, for example, a memory card 160 already inserted into an opening. Above memory card 160 is a battery 162 and the battery storage holder 164 removed from the electronic unit 152. When inserted, the holder 164 mates its electronic terminals 156 inside the electronic unit 152 and the battery 162 is held into place in the storage holder 164. The battery 162 and memory card 160 have terminals that mate with complimentary terminals on the storage holder 164. The electronic unit 152 has a liquid crystal display 164 and keypad locations 166.

In another embodiment, the electronic unit 152 is a light assembly to provide a light source to light up the paper inside the binder. For this light source to be utilized, instead of a memory card, the unit 160 is a light bulb assembly 160 located in the spot formerly used for the memory card. When used, the light bulb assembly 160 will direct light in the left and right side of the spine and light the paper. It is usable while being maintained in the presently unused volume.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. An apparatus for storing selected items within the covers of a ringed notebook or ringed binder, said notebook or binder being of a type that typically stores paper or accessories that do not extend to the full width of the covers thereby leaving presently unused volumes between the covers beyond the perimeter of the paper or other accessories, said apparatus comprising:

a thin main plate member having a plurality of spaced openings therethrough, said spaced openings being so arranged and sized so as to accommodate the rings of a ringed notebook or ringed binder; and storage means for storing at least one selected item, said storage means extending from said main plate member into a presently unused volume between the covers, wherein the normally unused volume can be utilized to store the selected item, said storage means comprising a plurality of spaced arms for grasping the at least one selected item.

2. The apparatus of claim 1, wherein storage means comprises a snap on holder.

3. The apparatus of claim 1, wherein said storage means comprises:

a) a storage plate member;

b) locking means associated with said storage plate member for securely attaching said storage plate member to said main plate member; and c) a storage item receiving element extending from a first end of said storage plate member wherein during use of said apparatus said storage item receiving element extends into the previously unused volume within the covers.

4. The apparatus of claim 3, wherein said locking means comprises:

a pair of tabs on a second end of said storage plate member for engagement with tabbed reception elements formed on a rear surface of said main plate member.

5. The apparatus of claim 4, wherein said locking means comprises:

an edge receiving tab element positioned on said storage plate member for engagement with a portion of the edge of said main plate member.

6. The apparatus of claim 5, wherein said storage plate member includes an opening formed therein to accommodate the rings.

7. The apparatus of claim 1, wherein said spaced arms, comprise:

a pair of opposed, spaced, circular reel receiving elements, each having a central opening therethrough for receiving the selected item, the selected item being a post of a reel.

8. The apparatus of claim 1, wherein said spaced arms, comprise:

a pair of spaced, generally U-shaped cylinder receiving elements for receiving the selected item, the selected item having a cylindrical shape.

9. The apparatus of claim 1, wherein the at least one selected item comprises a roll of material.

10. The apparatus of claim 9, wherein the roll of material comprises a roll of tape.

11. The apparatus of claim 1, wherein said storage means comprises means for storing a small flashlight.

12. The apparatus of claim 1, wherein said storage means comprises means for storing a glue.

13. The apparatus of claim 1, wherein said storage means comprises means for storing a lipstick.

14. The apparatus of claim 1, wherein said storage means comprises means for storing a writing instrument.

15. The apparatus of claim 1, wherein said storage means comprises means for storing a container.

16. The apparatus of claim 1, wherein said storage means comprises means for storing a recording device.

17. The apparatus of claim 1, wherein said storage means comprises means for storing a radio.

18. The apparatus of claim 1, wherein said storage means comprises means for storing a stapler.

19. The apparatus of claim 1, wherein said spaced arms are integrally connected.

20. The apparatus of claim 1, wherein said storage means is integrally connected to said main plate member.

21. The apparatus of claim 1, wherein tape from the roll of tape extends from the volume forward within the rings to said serrated edge.

22. The apparatus of claim 1, wherein the at least one selected item comprises a cellular telephone.

23. The apparatus of claim 1, wherein said storage means detachably stores the at least one selected item.

24. The apparatus of claim 1, wherein:

said thin main plate comprises an opening formed in an edge surface thereof and, wherein said storage means, comprises a male member sized to fit within said opening.

25. The apparatus of claim 24, wherein said male member and interior surfaces of said thin main plate which form said opening may engage each other and cooperate to provide an electrical connection therebetween.

26. The apparatus of claim 24, wherein said opening comprises an elongated slot and wherein said male member comprises a complimentary elongated electrical connector.

27. The apparatus of claim 26, wherein said grasping arms comprise electronic terminals in electrical communication with said elongated electrical connector.

28. The apparatus of claim 27, wherein said grasping arms comprise a battery storage holder.

29. The apparatus of claim 28, wherein said grasping arms comprise means for storing an electronic memory device.

30. The apparatus of claim 27, wherein said thin main plate comprises an electronic unit.

31. The apparatus of claim 1, wherein said grasping arms comprise a battery storage holder.

32. The apparatus of claim 1, wherein said grasping arms comprise means for storing an electronic memory device.

33. The apparatus of claim 1, wherein said grasping arms comprise means for storing a calculator.

34. The apparatus of claim 1, wherein said grasping arms comprise means for storing a clock.

35. The apparatus of claim 1, wherein said grasping arms comprise means for storing an electronic E-mail and data bank.

36. The apparatus of claim 1, wherein said grasping arms comprise means for storing a television.

37. A tape holder for use with an apparatus for storing selected items within the covers of a ringed notebook or ringed binder, said apparatus comprising:

a) a thin main plate member having a plurality of spaced openings therethrough, said spaced openings being so arranged and sized so as to accommodate the rings of a ringed notebook or ringed binder; and b) storage means for storing a plurality of selected items, said storage means extending from said main plate member into a presently unused volume between the covers, wherein the normally unused volume can be utilized to store the selected item, the storage means comprising a plurality of spaced arms for grasping the selected item, said tape holder, comprising:

a reel containing tape being so arranged and constructed as to be graspable by said spaced arms.

38. An apparatus for storing selected items within the covers of a ringed notebook or ringed binder, said notebook or binder being of a type that typically stores paper or accessories that do not extend to the full width of the covers thereby leaving presently unused volumes between the covers beyond the perimeter of the paper or other accessories, said apparatus comprising:

a thin main plate member having a plurality of spaced openings therethrough along a first side thereof, said spaced openings being so arranged and sized so as to accommodate the rings of a ringed notebook or ringed binder; and storage means for storing at least one selected item, said storage means extending from a second opposite side of said main plate member into a presently unused volume between the covers, wherein the normally unused volume can be utilized to store the selected item.

39. A light assembly for storing a light bulb assembly within the covers of a ringed notebook or ringed binder, said notebook or binder being of a type that typically stores paper or accessories that do not extend to the full width of the covers thereby leaving presently unused volumes between the covers beyond the perimeter of the paper or other accessories, said apparatus comprising:

a thin main plate member having a plurality of spaced openings therethrough, said spaced openings being so arranged and sized so as to accommodate the rings of a ringed notebook or ringed binder; and storage means for storing a light bulb assembly, said storage means extending from said main plate member into a presently unused volume between the covers, wherein the normally unused volume can be utilized to store the light bulb assembly, the light bulb assembly being usable while being maintained in the presently unused volume.

40. The apparatus of claim 1, wherein the at least one selected item comprises a cutting element.

41. An apparatus for storing a roll of material within the covers of a ringed notebook or ringed binder, said apparatus comprising:

a main plate member having a plurality of spaced openings therethrough, said spaced openings being so arranged and sized so as to accommodate the rings of a ringed notebook or ringed binder; and storage means for storing a roll of material, said storage means depending from said main plate member.

42. The apparatus of claim 41, wherein said storage means comprises means for storing a roll of tape.

43. The apparatus of claim 42, wherein said storage means comprises a cutting element formed thereon.

* * * * *